US009570008B2

(12) United States Patent
Lee

(10) Patent No.: US 9,570,008 B2
(45) Date of Patent: Feb. 14, 2017

(54) PIXEL CIRCUIT, ORGANIC LIGHT EMITTING DISPLAY DEVICE HAVING THE SAME, AND METHOD OF DRIVING AN ORGANIC LIGHT EMITTING DISPLAY DEVICE

(71) Applicant: SAMSUNG DISPLAY CO., LTD., Yongin, Gyeonggi-Do (KR)

(72) Inventor: Jae-Hoon Lee, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 203 days.

(21) Appl. No.: 14/447,036

(22) Filed: Jul. 30, 2014

(65) Prior Publication Data

US 2015/0070341 A1 Mar. 12, 2015

(30) Foreign Application Priority Data

Sep. 9, 2013 (KR) ..... 10-2013-0107729

(51) Int. Cl.
*G09G 3/325* (2016.01)
*G09G 3/32* (2016.01)

(52) U.S. Cl.
CPC ..... *G09G 3/325* (2013.01); *G09G 2300/0842* (2013.01); *G09G 2300/0861* (2013.01)

(58) Field of Classification Search
CPC ..... G09G 3/325; G09G 2300/0861; G09G 2300/0842
See application file for complete search history.

(56) References Cited

U.S. PATENT DOCUMENTS

2006/0170636 A1 8/2006 Nakamura et al.
2007/0200814 A1* 8/2007 Kwon ..... G09G 3/2022 345/92
2008/0100545 A1* 5/2008 Hong ..... G09G 3/325 345/82
2009/0027423 A1* 1/2009 Kwon ..... G09G 3/3233 345/690
2009/0135107 A1* 5/2009 Kim ..... G09G 3/3233 345/76
2010/0013868 A1* 1/2010 Chung ..... G09G 3/3233 345/690
2012/0162176 A1 6/2012 Kim et al.

FOREIGN PATENT DOCUMENTS

JP 2006-215274 B2 8/2006
KR 10-2009-0065740 A 6/2009
KR 10-2012-0074847 A 7/2012
KR 10-2014-0070441 A 7/2014

* cited by examiner

*Primary Examiner* — Kumar Patel
*Assistant Examiner* — Amy C Onyekaba
(74) *Attorney, Agent, or Firm* — Lee & Morse, P.C.

(57) ABSTRACT

A pixel circuit of an organic light emitting display device includes an emission unit, an emission control unit, a current supply unit, and a switch unit. The emission unit emits light based on an emission current. The emission control unit controls an emission operation of the emission unit based on a scan signal and a data signal. The current supply unit adjusts the emission current based on a current sinking operation performed based on an external constant current source, where the current supply unit is connected to the external constant current source. The switch unit controls an electrical connection operation between the emission control unit and the current supply unit.

19 Claims, 8 Drawing Sheets

PIXEL CIRCUIT, ORGANIC LIGHT EMITTING DISPLAY DEVICE HAVING THE SAME, AND METHOD OF DRIVING AN ORGANIC LIGHT EMITTING DISPLAY DEVICE

CROSS-REFERENCE TO RELATED APPLICATION

Korean Patent Application No. 10-2013-0107729, filed on Sep. 9, 2013, and entitled, "Pixel Circuit, Organic Light Emitting Display Device Having The Same, and Method of Driving an Organic Light Emitting Display Device," is incorporated by reference herein in its entirety.

BACKGROUND

1. Field

One or more embodiments described herein relate to a pixel circuit, display device, and method of driving the display device.

2. Description of the Related Art

An organic light emitting display device has advantages such as low power consumption, wide viewing angle, quick response time, and stability at low temperatures. Such a display device may use two methods to represent the gray scale levels of light emitted from its pixels. The first method is an analog driving method, and the second method is a digital driving method.

An analog driving method represents a gray scale level by controlling an amount of current applied to an organic light emitting diode based on a data signal. On the other hand, a digital driving method represents a gray scale level by controlling an emission time of an organic light emitting diode based on a data signal, under conditions where a constant amount of current is applied to the organic light emitting diode.

An organic light emitting display device employing a digital driving method may have a simpler structure compared to one employing an analog driving method. For this reason, organic light emitting display devices that are digitally driven are widely used. Moreover, these digitally driven devices may be more suitable for display panels having larger size and/or higher resolution.

SUMMARY

In accordance with one embodiment, a pixel circuit of an organic light emitting display device includes an emission unit configured to emit light based on an emission current; an emission control unit configured to control an emission operation of the emission unit based on a scan signal and a data signal; a current supply unit configured to adjust the emission current based on a current sinking operation performed based on an external constant current source, the current supply unit connected to the external constant current source; and a switch unit configured to control an electrical connection operation between the emission control unit and the current supply unit.

The emission unit may include an organic light emitting diode configured to emit the light based on the emission current. The emission control unit may include a first transistor having a gate electrode that receives the scan signal and a first electrode that receives the data signal; and a second transistor having a gate electrode connected to a second electrode of the first transistor, a first electrode connected to the switch unit, and a second electrode connected to the emission unit.

The first transistor may apply the data signal to the gate electrode of the second transistor in a turn-on period of the scan signal. The second transistor may supply the emission current to the emission unit in a turn-off period of the scan signal based on the data signal applied to the gate electrode of the second transistor.

The switch unit may include a fourth transistor having a gate electrode that receives the scan signal, a first electrode connected to the current supply unit, and a second electrode connected to the emission control unit, wherein a polarity of a channel of the fourth transistor is opposite to a polarity of a channel of the first transistor. The fourth transistor may separate the emission control unit from the current supply unit in the turn-on period of the scan signal.

The switch unit may include a third transistor having a gate electrode that receives an emission signal, a first electrode connected to the current supply unit, and a second electrode connected to the emission control unit. The third transistor may separate the emission control unit from the current supply unit in a turn-off period of the emission signal, the turn-off period of the emission signal corresponding to the turn-on period of the scan signal.

The current supply unit may include a storage capacitor having a first electrode connected to a power supply voltage; a fifth transistor having a gate electrode connected to a second electrode of the storage capacitor, a first electrode connected to the power supply voltage, and a second electrode connected to the switch unit; a sixth transistor having a gate electrode that receives the scan signal, a first electrode connected to the second electrode of the fifth transistor, and a second electrode connected to the gate electrode of the fifth transistor; and a seventh transistor having a gate electrode that receives the scan signal, a first electrode connected to the second electrode of the fifth transistor, and a second electrode connected to the external constant current source. A sinking current flowing through the external constant current source may be determined to be the emission current.

The seventh transistor may connect the external constant current source with the second electrode of the fifth transistor in the turn-on period of the scan signal, to allow the sinking current to flow between the first electrode of the fifth transistor and the second electrode of the fifth transistor.

The sixth transistor may connect the second electrode of the fifth transistor with the second electrode of the storage capacitor in the turn-on period of the scan signal, to change an amount of charges of the storage capacitor.

The storage capacitor may store a voltage difference between the first electrode of the fifth transistor and the gate electrode of the fifth transistor in the turn-on period of the scan signal, the voltage difference caused by the sinking current flowing between the first electrode of the fifth transistor and the second electrode of the fifth transistor.

The fifth transistor may generate the emission current based on the voltage difference stored in the storage capacitor in the turn-off period of the scan signal.

In accordance with another embodiment, an organic light emitting display device includes a display panel having a plurality of pixel circuits to control emission of light based on an emission current; a current driver having at least one constant current source to determine the emission current based on a sinking current operation for each of the pixel circuits; a scan driver configured to provide a scan signal to the pixel circuits; a data driver configured to provide data signals to the pixel circuits; and a timing controller configured to control the current driver, scan driver, and data driver.

Each pixel circuit may include an emission unit configured to emit light based on the emission current; an emission control unit configured to control an emission operation of the emission unit based on the scan signal and data signal; a current supply unit configured to adjust the emission current based on the current sinking operation, the current supply unit connected to the constant current source; and a switch unit configured to control an electrical connection operation between the emission control unit and current supply unit.

The emission unit may include an organic light emitting diode configured to emit the light based on the emission current. A sinking current flowing through the constant current source in a turn-on period of the scan signal may correspond to the emission current supplied in a turn-off section of the scan signal to the organic light emitting diode.

In accordance with another embodiment, a method of driving an organic light emitting display device includes determining an emission current for each of plurality of pixel circuits based on a current sinking operation performed by a constant current source in a turn-on period of a scan signal; and controlling an organic light emitting diode of each of the pixel circuits to emit light by supplying the emission current to the organic light emitting diode in a turn-off period of the scan signal.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

Also, it will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Figure 1:
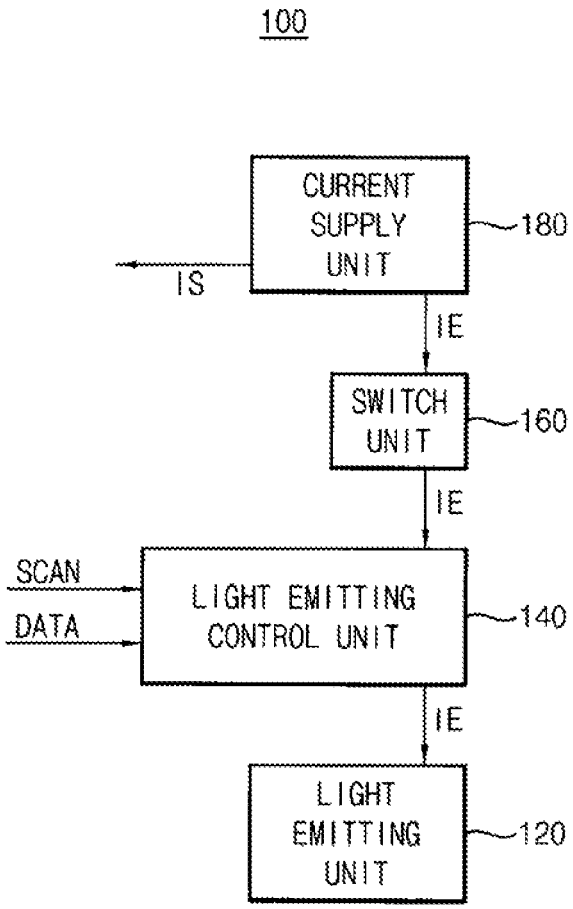
FIG. 1 illustrates an embodiment of a pixel circuit.

FIG. 1 illustrates an embodiment of a pixel circuit 100 of an organic light emitting display device. The pixel circuit 100 may prevent non-uniformity in image quality, even when a transistor that supplies an emission current IE has dispersion characteristics caused by external factors such as manufacturing process defects, etc.

Referring to FIG. 1, The pixel circuit 100 includes an emission unit 120, an emission control unit 140, a switch unit 160, and a current supply unit 180. Emission unit 120 may emit light based on emission current IE controlled by current supply unit 180. The emission unit 120 may include an organic light emitting diode, which emits light when emission current IE flows through the organic light emitting diode.

Based on a scan signal SCAN and a data signal DATA, the emission control unit 140 may determine whether to supply the emission current IE to the emission unit 120 to control emission of the emission unit 120. Specifically, the scan signal SCAN may control timings for the emission control unit 140 to receive the data signal DATA. The data signal DATA may include information for supplying the emission current IE to the emission unit 120. Based on information of the data signal DATA, the emission control unit 140 may determine whether to supply the emission current IE to the emission unit 120.

For example, when using a digital driving technique for the display device, a frame may be divided into a plurality of sub-frames. The emission time of each sub-frame may be different by a predetermined factor, e.g., a factor of 2. The emission control unit 140 may supply the emission current IE to the emission unit 120 based on data signal DATA in each of the sub-frames. Thus, the emission unit 120 may emit light. As a result, a specific gray scale level may be displayed based on a sum of respective emission times of the sub-frames.

The switch unit 160 may control an electrical connection operation between the emission control unit 140 and the current supply unit 180. For example, the switch unit 160 may connect the emission control unit 140 to the current supply unit 180 when the emission control unit 140 and the current supply unit 180 are to perform a combined operation. The emission control unit 140 may be separated from the current supply unit 180 when the emission control unit 140 and the current supply unit 180 are to perform separate operations.

The current supply unit 180 may be connected to an external constant current source, to the control emission current IE based on a current sinking operation. The external constant current source may generate a sinking current IS, and the current supply unit 180 may determine emission current IE based on sinking current IS. In one embodiment, the current supply unit 180 may determine the sinking current IS to be the emission current IE.

Figure 2:
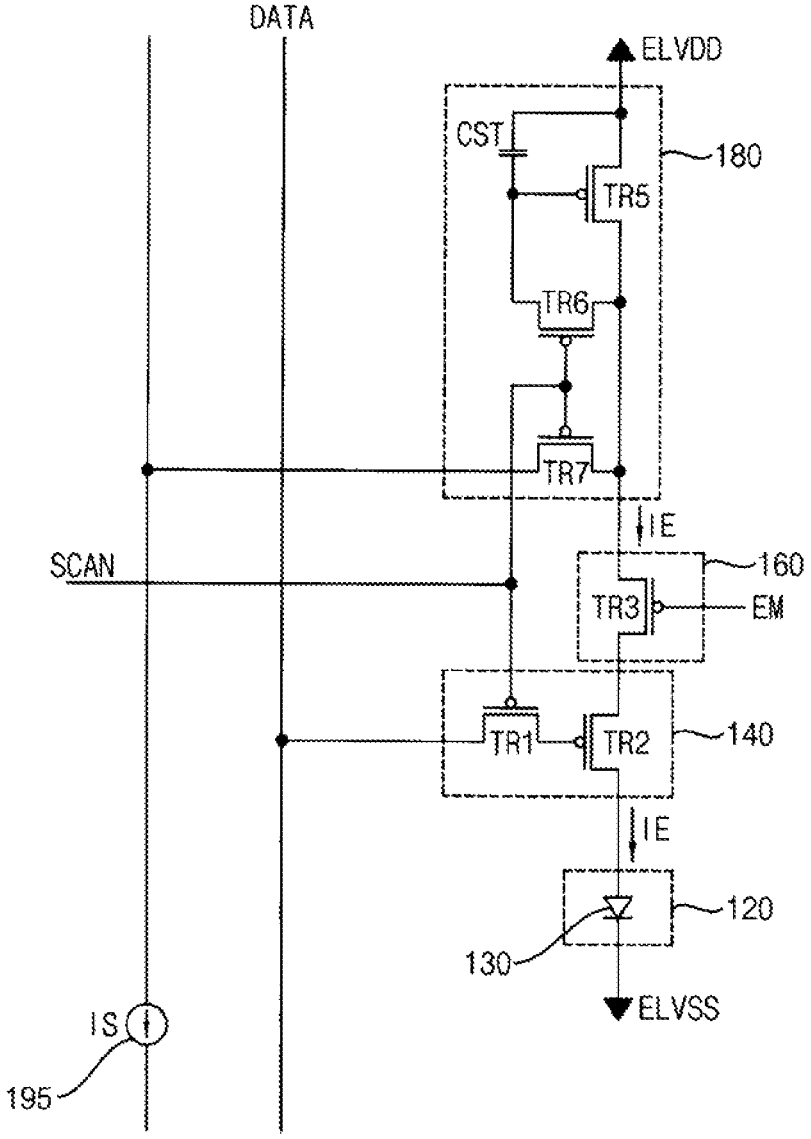
FIG. 2 illustrates an example in which a sinking current of an external constant current source is determined to be an emission current in the pixel circuit.

FIG. 2 illustrates an example in which a sinking current of an external constant current source is determined to be the emission current in the pixel circuit of FIG. 1. Referring to FIG. 2, the emission unit 120 may include an organic light emitting diode 130. The emission control unit 140 may include a first transistor TR1 and a second transistor TR2. A switch unit 160 may include a third transistor TR3. The current supply unit 180 may include a storage capacitor CST, a fifth transistor TR5, a sixth transistor TR6, and a seventh transistor TR7.

The emission unit 120 may include the organic light emitting diode 130 as a light-emitting element. An anode of the organic light emitting diode 130 may be connected to the emission control unit 140, and a cathode of the organic light emitting diode 130 may be connected to a low power supply voltage ELVSS. When the emission current IE flows through the organic light emitting diode 130, the organic light emitting diode 130 emits light based on recombination of holes and electrons in the organic light emitting diode 130.

The emission control unit 140 may include first transistor TR1 and second transistor TR2. The first transistor TR1 may have a gate electrode that receives the scan signal SCAN and a first electrode that receives data signal DATA. The second transistor TR2 may have a gate electrode connected to a second electrode of the first transistor TR1, a first electrode connected to switch unit 160, and a second electrode connected to emission unit 120. The first transistor TR1 may apply the data signal DATA to the second transistor TR2 based on scan signal SCAN. The second transistor TR2 may supply the emission current IE to emission unit 120 based on the applied data signal DATA. In one example embodiment, the emission control unit 140 may include a storage capacitor having a first electrode connected to the gate electrode of the second transistor TR2 and a second electrode connected to the power supply voltage ELVDD.

The switch unit 160 may include a third transistor TR3 having a gate electrode that receives the emission signal EM, a first electrode connected to current supply unit 180, and a second electrode connected to the emission control unit 140. The third transistor TR3 may control an electrical connection operation between the emission control unit 140 and the current supply unit 180 based on the emission signal EM. For example, the switch unit 160 may connect the emission control unit 140 to the current supply unit 180 when the gate electrode of the third transistor TR3 receives an activated emission signal EM in a turn-on period of the emission signal EM. The switch unit 160 may separate the emission control unit 140 from the current supply unit 180 when the gate electrode of the third transistor TR3 receives an inactivated emission signal EM in a turn-off period of the emission signal EM.

The current supply unit 180 may include the storage capacitor CST, the fifth transistor TR5, the sixth transistor TR6, and the seventh transistor TR7. The storage capacitor CST may have a first electrode connected to the power supply voltage ELVDD. The fifth transistor TR5 may have a gate electrode connected to a second electrode of the storage capacitor CST, a first electrode connected to the power supply voltage ELVDD, and a second electrode connected to the switch unit 160.

The sixth transistor TR6 may have a gate electrode that receives scan signal SCAN, a first electrode connected to the second electrode of the fifth transistor TR5, and a second electrode connected to the gate electrode of the fifth transistor TR5.

The seventh transistor TR7 may have a gate electrode that receives the scan signal SCAN, a first electrode connected to the second electrode of the fifth transistor TR5, and a second electrode connected to the external constant current source which, for example, may be located outside the pixel circuit.

The storage capacitor CST may store a voltage difference between the gate electrode and the first electrode of the fifth transistor TR5. The fifth transistor TR5 may supply the emission current IE based on the voltage difference between the gate electrode and the first electrode. The sixth transistor TR6 may connect the gate electrode of the fifth transistor TR5 to the second electrode of the fifth transistor based on scan signal SCAN. The seventh transistor TR7 may connect constant current source 195 to the second electrode of the fifth transistor TR5.

Figure 3:
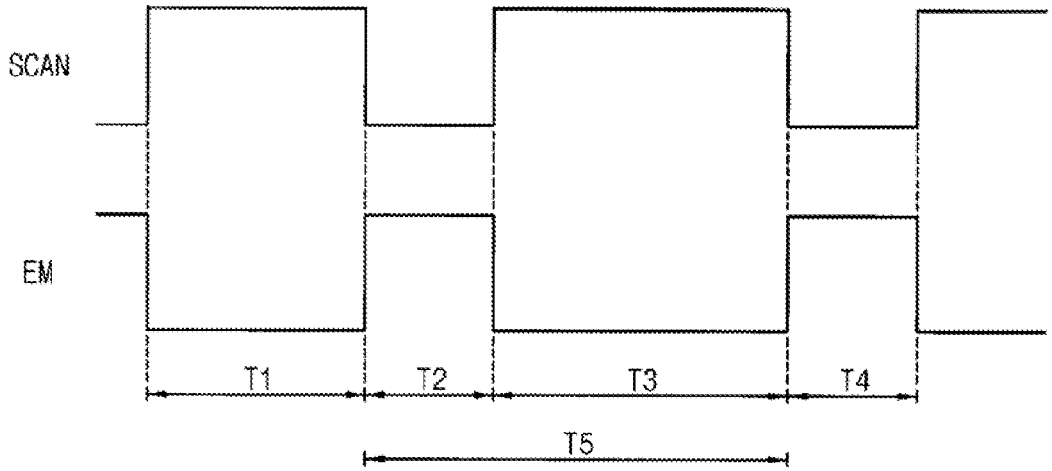
FIG. 3 illustrates an example of a turn-on period and a turn-off period of each of a scan signal and an emission signal in the pixel circuit.

FIG. 3 illustrates an example of a turn-on period and a turn-off period for a scan signal and an emission signal for the pixel circuit of FIG. 1. Referring to FIG. 3, scan signal SCAN may have turn-off periods T1 and T3 and turn-on periods T2 and T4 for p-channel metal oxide semiconductor (PMOS) switching transistors TR1, TR6, and TR7. In addition, emission signal EM may have turn-on periods T1 and T3 and turn-off periods T2 and T4 for a PMOS switching transistor TR3.

A period T5 including the turn-off period T2 of the emission signal EM and the turn-on period T3 just after the turn-off period T2 may be included in one sub-frame. As illustrated in FIG. 3, the emission signal EM has turn-on periods T1 and T3 and turn-off periods T2 and T4 that are alternately repeated. A turn-on period of the scan signal SCAN may correspond to a turn-off period of the emission signal EM (e.g., shown in T2 and T4 periods). A turn-off period of the scan signal SCAN may correspond to a turn-on period of emission signal EM (e.g., shown in T1 and T3 periods). However, it may be sufficient that a turn-on period of the scan signal SCAN is included in a turn-off period of the emission signal EM.

Figure 4:
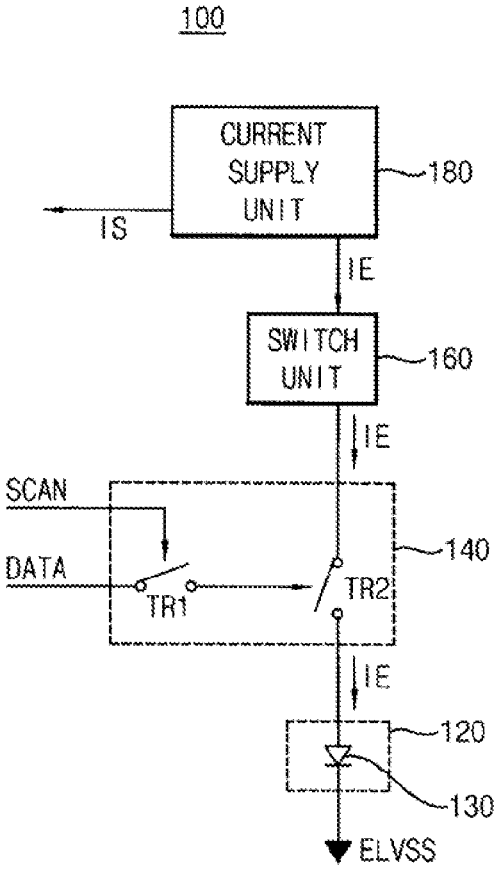
FIG. 4 illustrates an example in which an emission unit and emission control unit operate to determine a sinking current of an external constant current source to be an emission current in the pixel circuit.

FIG. 4 illustrates an example in which an emission unit and emission control unit operate to determine a sinking current of an external constant current source to be an emission current in the pixel circuit of FIG. 1.

Referring to FIGS. 3 and 4, a first switching transistor TR1 may apply a data signal DATA to a second switching transistor TR2 in a turn-on period T2 of a scan signal SCAN. The applied data signal DATA may be stored in a parasitic capacitance element generated between a gate electrode of the second switching transistor TR2 and a power supply voltage. According to one embodiment, the applied data signal DATA may be stored in a storage capacitor having a first electrode connected to a gate electrode of the second switching transistor TR2, and a second electrode connected to a power supply voltage. Based on the stored data signal DATA, the second switching transistor TR2 may determine whether to supply an emission current IE to an emission unit 120, until the second switching transistor TR2 receives a new data signal DATA in a turn-on period T4 of a next scan signal SCAN.

An organic light emitting diode 130 of the emission unit 120, to which an emission current IE is supplied, may emit light based on recombination of holes and electrons in the organic light emitting diode 130 when the emission current IE is supplied to the organic light emitting diode 130.

For example, the data signal DATA includes information on whether the organic light emitting diode 130 is to emit light in sub-frame T5. This data signal DATA may be applied to the second switching transistor TR2 in the turn-on period T2 of the scan signal SCAN in the sub-frame T5 by the first switching transistor TR1. The applied data signal DATA may be stored in a parasitic capacitance element generated between the gate electrode of the second switching transistor TR2 and the power supply voltage. The emission control unit 140 may supply the emission current IE to the emission unit 120 in a turn-on period T3 of the emission signal EM in sub-frame 15 based on information of the applied data signal DATA. The organic light emitting diode 130, to which the emission current IE is supplied, may emit light based on recombination of holes and electrons in the organic light emitting diode 130.

Figure 5A:
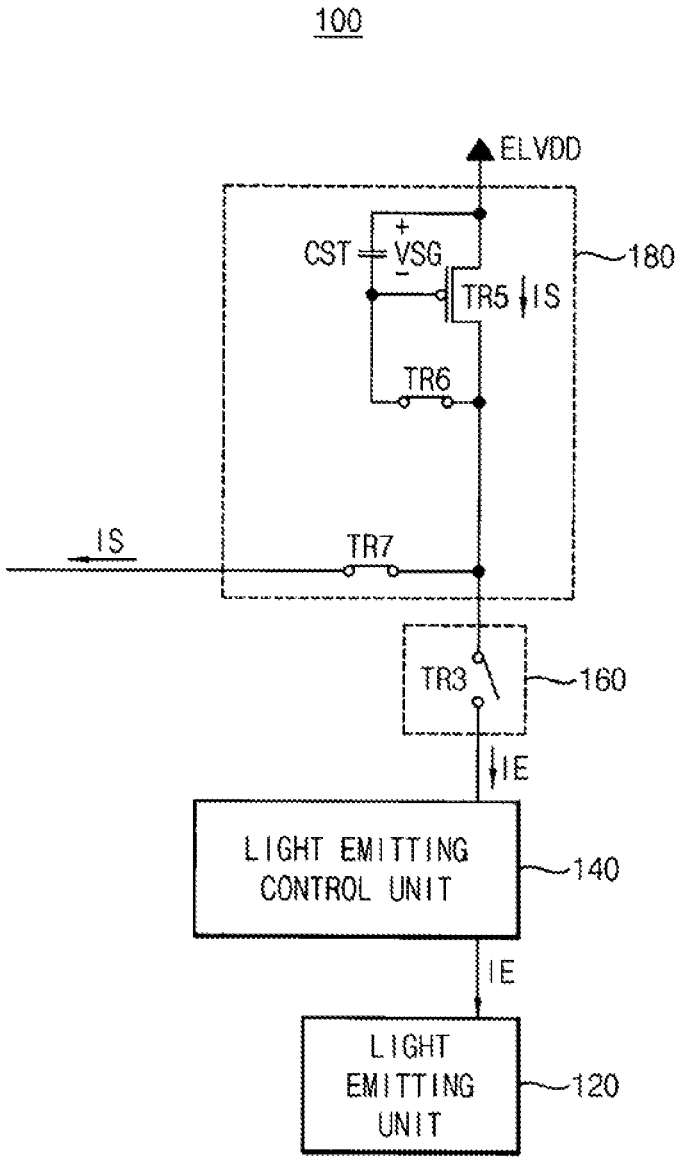
FIGS. 5A and 5B illustrate examples in which a current supply unit and a switch unit operate to determine a sinking current of an external constant current source to be an emission current in the pixel circuit.
Figure 5B:
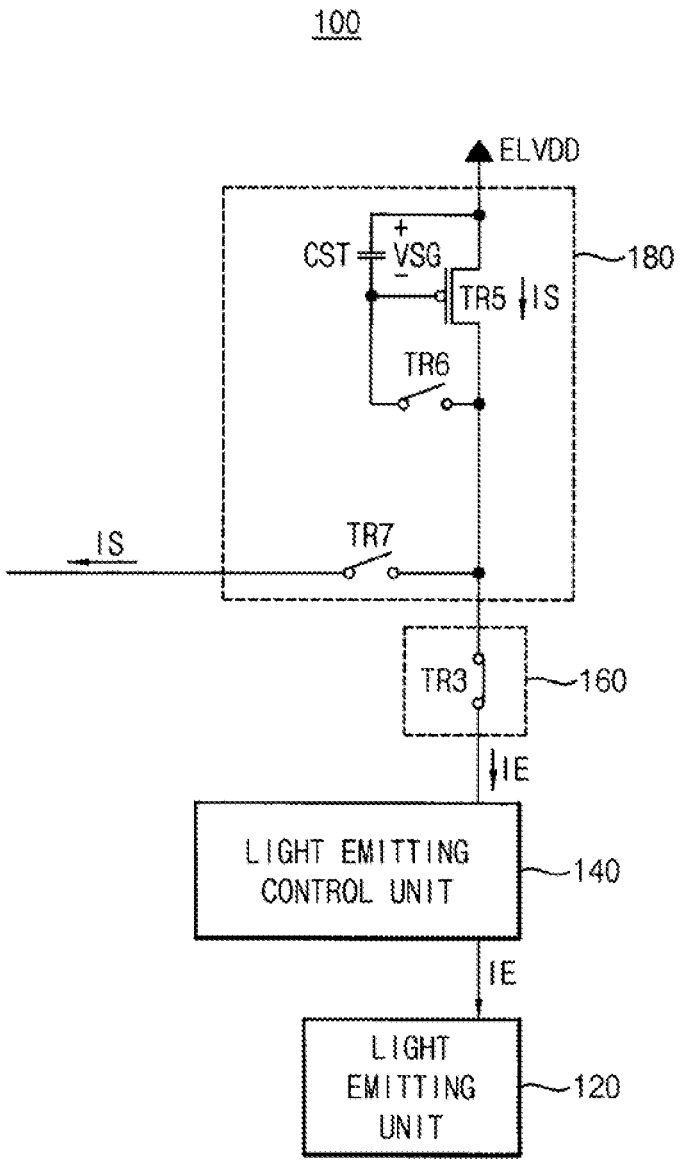

FIGS. 5A and 5B illustrate examples in which a current supply unit and switch unit operate to determine a sinking current of an external constant current source to be an emission current in the pixel circuit of FIG. 1.

FIG. 5A illustrates an operation related to the pixel circuit 100 of FIG. 1, in which the sinking current IS is determined to be emission current IE in turn-on periods T2 and T4 of the scan signal SCAN. FIG. 5B illustrates an operation related to the pixel circuit 100 of FIG. 1 by which the emission current IE as the sinking current IS is supplied to the emission unit 120 by the switch unit 160 and the current supply unit 180 in turn-on periods 1 and T3 of the emission signal EM.

As shown in FIG. 5A, a third switching transistor TR3 may be open in turn-on periods T2 and T4 of the scan signal SCAN. A sixth switching transistor TR6 and a seventh switching transistor TR7 may be short in turn-on periods T2 and T4 of the scan signal SCAN. In this case, the sinking current IS from an external constant current source may flow through the fifth transistor TR5. A voltage difference VSG between a gate electrode of fifth transistor TR5 and a source electrode of fifth transistor TR5 may be generated according to Equation 1, when the fifth transistor TR5 operates in the saturation region. The voltage difference VSG between the gate electrode and the source electrode of the fifth transistor TR5 may be stored in the storage capacitor CST based on current flowing through the sixth transistor TR6.

$$IS = \frac{\beta}{2}(v_{sg} - V_t)^2 \tag{1}$$

In Equation 1, β is a constant determined by channel width and length and intrinsic characteristics of the sixth switching transistor T6. Vt denotes a threshold voltage of the sixth switching transistor T6.

As shown in FIG. 5B, the third switching transistor TR3 may be short in turn-on periods T1 and T3 of the emission signal EM. The sixth switching transistor TR6 and seventh switching transistor TR7 may be open in turn-on periods T1 and T3 of the emission signal EM. In this case, the voltage difference VSG generated between the gate electrode and the source electrode of the fifth transistor TR5 may be maintained, because charges are trapped in the storage capacitor CST. The fifth transistor TR5 may determine the emission current IE according to Equation 2, when the fifth transistor TR5 operates in the saturation region. As a result, the current supply unit 180 may supply the emission current IE to the emission unit 120 via the switch unit 160. In this case, the amount of emission current IE may be the same as the amount of sinking current IS. Because the sinking current IS is determined to be emission current IE based on a current sinking operation of the external constant current source, non-uniformity in an image quality due to a transistor that supplies the emission current IE may be prevented.

$$IE = \frac{\beta}{2}(v_{sg} - V_t)^2 \tag{2}$$

In Equation 2, β is a constant determined by channel width and length and intrinsic characteristics of the sixth switching transistor T6. Vt denotes a threshold voltage of the sixth switching transistor T6.

Figure 6:
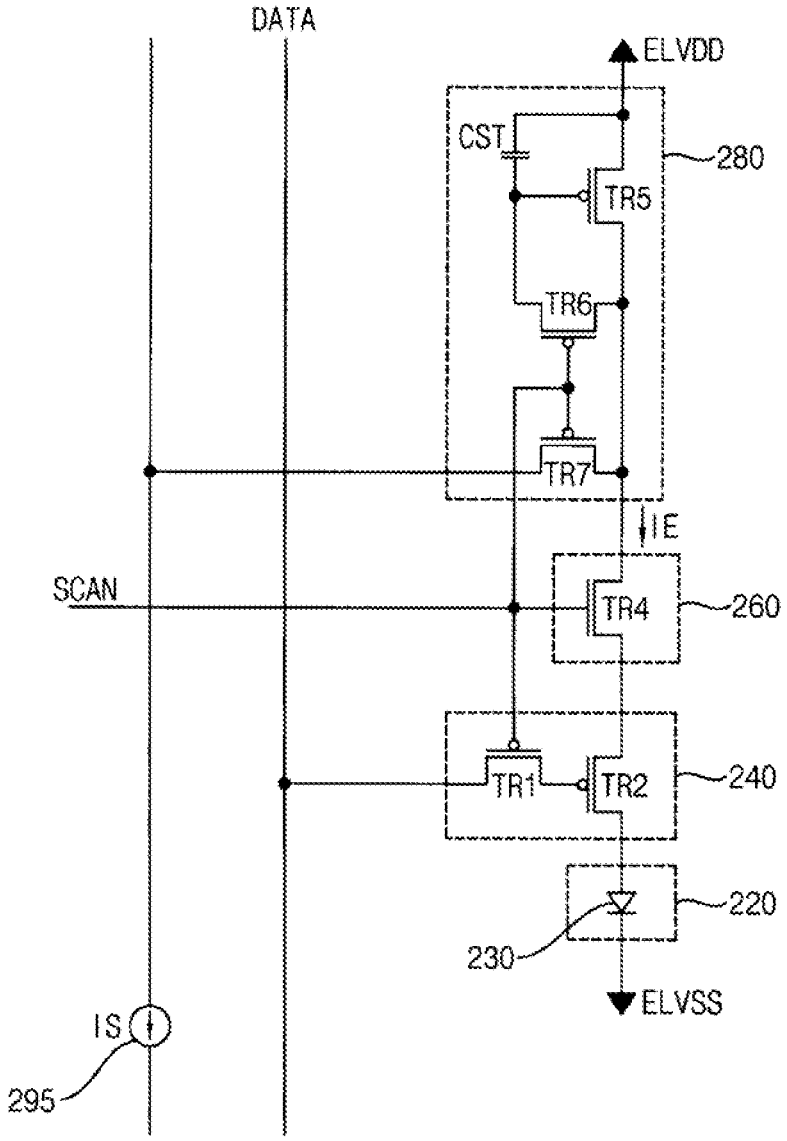
FIG. 6 illustrates another example in which a sinking current of an external constant current source is determined to be an emission current in the pixel circuit.

FIG. 6 illustrates another example in which a sinking current of an external constant current source is determined to be an emission current in the pixel circuit of FIG. 1. Referring to FIG. 6, an emission unit 220 may include organic light emitting diode 230, an emission control unit 240 may include a first transistor TR1 and a second transistor TR2. A switch unit 260 may include a fourth transistor TR4. A current supply unit 280 may include a storage capacitor CST, a fifth transistor TR5, a sixth transistor TR6, and a seventh transistor TR7. Operations of the emission unit 220, the emission control unit 240, and the current supply unit 280, except switch unit 260, may be substantially the same as operations of the emission unit 120, the emission control unit 140, and the current supply unit 180 of FIG. 2.

The emission unit 220 may include an organic light emitting diode 230 as a light-emitting device. An anode of the organic light emitting diode 230 may be connected to emission control unit 240, and a cathode of the organic light emitting diode 230 may be connected to low power supply voltage ELVSS. When the emission current IE flows through the organic light emitting diode 230, the organic light emitting diode 230 may emit light based on recombination of holes and electrons in the organic light emitting diode 230.

The emission control unit 240 may include first transistor TR1 and second transistor TR2. The first transistor TR1 may have a gate electrode that receives a scan signal SCAN and a first electrode that receives a data signal DATA. The second transistor TR2 may have a gate electrode connected to a second electrode of the first transistor TR1, a first electrode connected to the switch unit 260, and a second electrode connected to emission unit 220. A first transistor TR1 may apply data signal DATA to second transistor TR2 based on the scan signal SCAN of the first transistor TR1. The second transistor TR2 may supply the emission current IE to the emission unit 220 based on the applied data signal DATA.

The switch unit 260 may include fourth transistor TR4 having a gate electrode that receives scan signal SCAN, a first electrode connected to current supply unit 280, and a second electrode connected to emission control unit 240. A polarity of a channel of the fourth transistor TR4 may be opposite to a polarity of channels of the first transistor TR1, the sixth transistor TR6, and the seventh transistor TR7. The fourth transistor TR4 may separate the emission control unit 240 from current supply unit 280 based on scan signal SCAN.

The current supply unit 280 may include storage capacitor CST, fifth transistor TR5, sixth transistor TR6, and seventh transistor TR7. The storage capacitor CST may have a first electrode connected to a power supply voltage ELVDD. The fifth transistor TR5 may have a gate electrode connected to a second electrode of storage capacitor CST, a first electrode connected to power supply voltage ELVDD, and a second electrode connected to switch unit 260.

The sixth transistor TR6 may have a gate electrode that receives scan signal SCAN, a first electrode connected to the second electrode of fifth transistor TR5, and a second electrode connected to the gate electrode of fifth transistor TR5.

The seventh transistor TR7 may have a first electrode connected to the second electrode of fifth transistor TR5 and a second electrode connected to a constant current source 295, which, for example, may be located outside of the pixel circuit.

The storage capacitor CST may store a voltage difference between the gate electrode and first electrode of fifth transistor TR5. The fifth transistor TR5 may supply emission current IE based on the voltage difference between the gate electrode and first electrode of fifth transistor TR5. The sixth transistor TR6 may connect the gate electrode of fifth transistor TR5 to the second electrode of the fifth transistor TR5 based on the scan signal SCAN. The seventh transistor TR7 may connect the constant current source 295 to the second electrode of the fifth transistor TR5 based on the scan signal SCAN.

Because the polarity of the channel of the fourth transistor TR4 is opposite to the polarity of the channels of the first transistor TR1, sixth transistor TR6, and seventh transistor TR7, the fourth transistor TR4 may perform an open-operation in a turn-on period of the scan signal SCAN and may perform a short-operation in a turn-off period of the scan signal SCAN. As a result, emission signal EM of FIG. 2 may not be required because the fourth transistor TR4 performs the same operation performed by third transistor TR3 of FIG. 2 performs.

Figure 7:
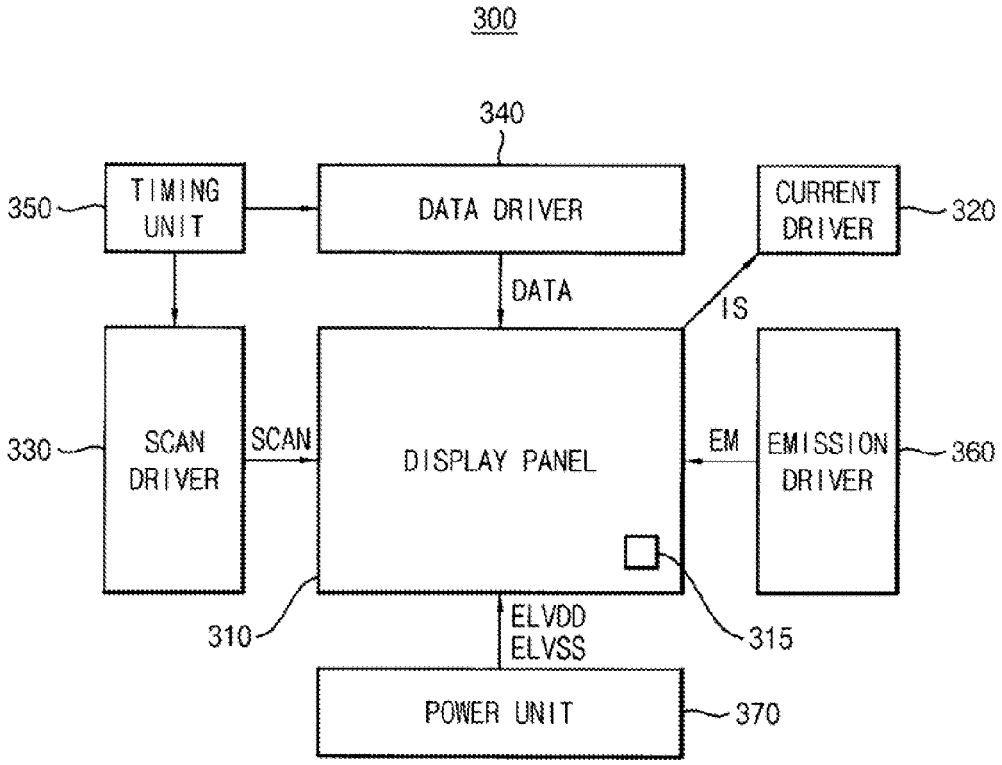
FIG. 7 illustrates an embodiment of an organic light emitting display device.

FIG. 7 illustrates an embodiment of an organic light emitting display device 300. This embodiment may prevent non-uniformity in image quality, even when a transistor that supplies an emission current has dispersion characteristics due to external factors such as manufacturing process defects, etc.

Referring to FIG. 7, organic light emitting display device 300 includes a display panel 310, a current driver 320, a scan driver 330, a data driver 340, and a timing controller 350. In one embodiment, the organic light emitting display device 300 may further include an emission driver 360 and a power supply 370.

The display panel 310 may include a plurality of pixel circuits 315, scan lines, emission control lines, data lines, and sinking current lines. Each of the pixel circuits 315 may have an emission unit. The scan lines may be formed along the row direction to transmit a scan signal SCAN. The emission control lines may be formed along the row direction to transmit an emission signal EM. The data lines may be formed along the column direction to transmit data signals DATAs.

The sinking current lines may be formed along the column direction to allow for a sinking current IS. The pixel circuits 315 may store the data signal DATA based on the scan signal SCAN, and may perform an emission operation based on data signal DATA stored in pixel circuit 315 based on emission signal EM. To the extent that the configuration and operation of pixel circuits 315 in display panel 310 are substantially same as the pixel circuit in FIG. 1 through FIG. 6, the duplicated description will not be repeated.

The current driver 320 may perform a current sinking operation for each of the pixel circuits 315, by being connected to sinking current lines to apply sinking current IS to each of pixel circuits 315. The scan driver 330 may allow each of the pixel circuits 315 to store data signal DATA, by being connected to scan lines to apply the scan signal SCAN controlling each of the pixel circuits 315 to display panel 310. The data driver 340 may be connected to the data lines, and may apply data signal DATA to each of the pixel circuits 315. The data signal DATA may have emission information of the emission unit in each of the pixel circuits 315.

The timing control unit 350 may control a driving timing of the current driver 320, scan driver 330, and data driver 340. Furthermore, according to one embodiment, timing controller 350 may control the driving timing of emission driver 360. The emission driver 360 may control emission of the emission unit in each of the pixel circuits 315, by being connected to the emission control lines to apply the emission control signal EM to display panel 310. The power supply 370 may apply a power supply voltage ELVDD and a low power supply voltage ELVSS to each of the pixel circuits 315.

Figure 8:
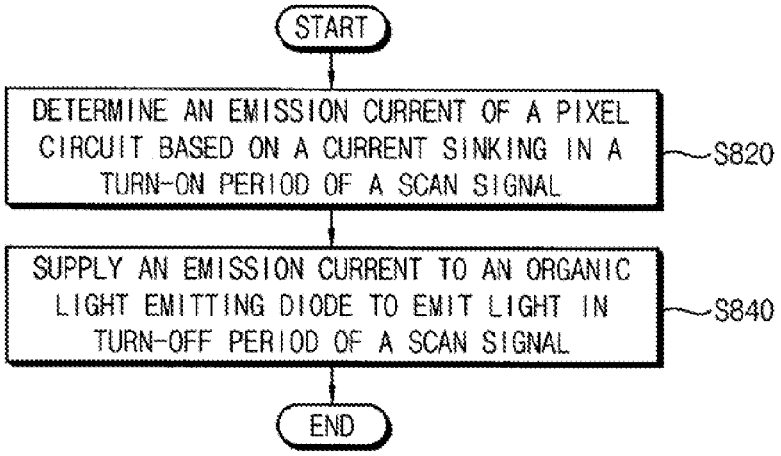
FIG. 8 illustrates an embodiment of a method for driving an organic light emitting display device.

FIG. 8 illustrates an embodiment of a method for driving an organic light emitting display device including a plurality of pixel circuits, each having an organic light emitting diode and a switching device that controls supply-block operation of an emission current flowing through the organic light emitting diode.

Referring to FIG. 8, the method may include determining the emission current for each of the pixel circuits based on a current sinking operation of a constant current source (located outside of each of the pixel circuits) in a turn-on period of a scan signal (S820). The method may control an organic light emitting diode in each of the pixel circuits to emit light in a turn-off period of a scan signal by supplying the determined emission current (S840).

The emission current may be determined based on the current sinking operation (S820). Here, a storage capacitor may store a voltage difference between a gate electrode and a source electrode of a transistor supplying the emission current in the turn-on period of the scan signal. The voltage difference may be generated by a sinking current flowing through the transistor. The transistor may determine an amount of the emission current to be the same as an amount of the sinking current based on the voltage difference stored in the storage capacitor in the turn-off period of the scan signal.

The organic light emitting diode may be supplied with the determined current to emit light (S840). Here, the organic light emitting diode may emit light based on recombination of holes and electrons in the organic light emitting diode. Thus, the method of FIG. 8 may prevent non-uniformity in image quality, even when a transistor that supplies the emission current has dispersion characteristics caused by external factors such as manufacturing process defects, etc. This is because the sinking current is determined to be the emission current based on the current sinking operation of the external constant current source.

Figure 9:
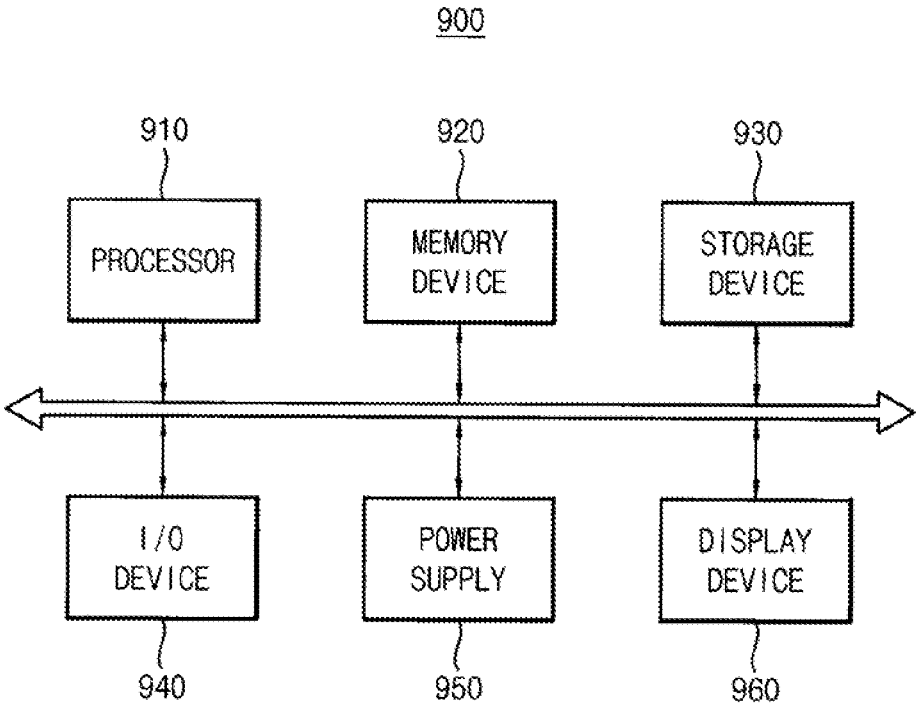
FIG. 9 illustrates an embodiment of an electronic system having an organic light emitting display device according to any of the aforementioned embodiments.

FIG. 9 illustrates an embodiment of an electronic system 900 having an organic light emitting display device. Referring to FIG. 9, electronic system 900 includes a processor 910, a memory device 920, a storage device 930, an input/output (I/O) device 940, a power supply 950, and an organic light emitting display device 960. The electronic system 900 may also include a plurality of ports for communicating with a video card, a sound card, a memory card, a universal serial bus (USB) device, and/or other electronic systems.

The processor 910 may perform various computing functions or tasks. The processor 910 may be, for example, a microprocessor, a central processing unit (CPU), or other processing device or controller. The processor 910 may be connected to other components via an address bus, a control bus, a data bus, etc. Further, processor 910 may be coupled to an extended bus such as a peripheral component interconnection (PCI) bus.

The memory device 920 may store data for operations of the electronic system 900. For example, memory device 920 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and, or at least one volatile memory device such as a dynamic random access memory (DRAM) device, a static random access memory (SRAM) device, a mobile dynamic random access memory (mobile DRAM) device, etc.

The storage device 930 may be, for example, a solid state drive (SSD) device, a hard disk drive (HDD) device, a CD-ROM device, etc. The I/O device 940 may be, for example, an input device such as a keyboard, a keypad, a mouse, a touch screen, etc, and/or an output device such as a printer, a speaker, etc. The power supply 950 may supply power for operations of the electronic system 900. The organic light emitting display device 960 may communicate with other components via the buses or other communication links.

The organic light emitting display device 960 may include a display panel 310 having pixel circuits 315, a current driver 320, a scan driver 330, a data driver 340, and a timing controller 350 of FIG. 7. Each pixel circuit 315 may include an emission unit 120 and 220, an emission control unit 140 and 240, a switch unit 160 and 260, and a current supply unit 180 and 280 of FIGS. 2 and 6.

In one embodiment, emission unit 120 may include organic light emitting diode 130 of FIG. 2. The emission control unit 140 may include a first transistor and a second transistor of FIG. 2. The switch unit 160 may include a third transistor of FIG. 2. The current supply unit 180 may include a fifth transistor, sixth transistor, seventh transistor, and storage capacitor of FIG. 2.

In another embodiment, the emission unit 220 may include an organic light emitting diode 230. The emission control unit 240 may include a first transistor and a second transistor of FIG. 6. The switch unit 260 may include a fourth transistor of FIG. 6. The current supply unit 280 may include a fifth transistor, sixth transistor, seventh transistor, and storage capacitor of FIG. 6.

On this wise, organic light emitting display device 960 may include the current driver 320 having at least one constant current source 195 and 295 of FIGS. 2 and 6 connected to a pixel circuit to perform a current sinking operation. The pixel circuit may determine a sinking current IS of FIG. 2 to be emission current IE of FIG. 2, based on the current sinking operation of current driver 320.

Thus, uniform image quality may be implemented because generating a non-uniform current due to dispersion characteristics of a transistor supplying the emission current may be prevented. In other words, the electronic system 900 including the organic light emitting display device 960 may not need additional optical compensation, may remove dispersion characteristics due to environmental changes, and/or may compensate for degradation that occurs after long-time operation.

The present embodiments may be applied to any electronic system 900 having the organic light emitting display device 960. For example, the present embodiments may be applied to the electronic system 900 such as a television, a computer monitor, a laptop, a digital camera, a cellular phone, a smart phone, a personal digital assistant (PDA), a portable multimedia player (PMP), a MP3 player, a navigation system, or a video phone, as well as other electronic devices or systems.

By way of summation and review, if a constant voltage is applied to organic light emitting diodes of an organic light emitting display device employing a digital driving method, emission current flowing through respective ones of the diodes may differ from each other due to V-I shift characteristics of the diodes.

In attempt to overcome this effect, another digital driving method applies a constant current to an organic light emitting diode as an emission current. However, if a transistor that provides the emission current has dispersion characteristics caused by external factors (such as manufacturing process defects), non-uniformity in image quality may occur. Attempts have been made to solve this non-uniformity in image quality by performing data remapping based on an initial optical compensation. However, these attempts have proven to be insufficient in one or more ways.

In accordance with one or more of the aforementioned embodiments, a pixel circuit of an organic light emitting display device prevents non-uniformity in image quality, even when a transistor that supplies emission current has dispersion characteristics due to external factors such as manufacturing process defects.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A pixel circuit of an organic light emitting display device, the pixel circuit comprising:

an emitter to emit light based on an emission current;

an emission controller to control an emission operation of the emitter based on a scan signal and a data signal;

a current supply circuit to adjust the emission current based on a current sinking operation performed based on an external constant current source, the current supply circuit connected to the external constant current source; and a switch to control an electrical connection operation between the emission controller and the current supply circuit.

2. The device as claimed in claim 1, wherein the emitter includes: an organic light emitting diode to emit the light based on the emission current.

3. The device as claimed in claim 2, wherein the emission controller includes:

a first transistor having a gate electrode that receives the scan signal and a first electrode that receives the data signal; and a second transistor having a gate electrode connected to a second electrode of the first transistor, a first electrode connected to the switch, and a second electrode connected to the emitter.

4. The device as claimed in claim 3, wherein the first transistor applies the data signal to the gate electrode of the second transistor in a turn-on period of the scan signal.

5. The device as claimed in claim 4, wherein the second transistor supplies the emission current to the emitter in a turn-off period of the scan signal based on the data signal applied to the gate electrode of the second transistor.

6. The device as claimed in claim 5, wherein the switch includes: a fourth transistor having a gate electrode that receives the scan signal, a first electrode connected to the current supply circuit, and a second electrode connected to the emission controller, wherein a polarity of a channel of the fourth transistor is opposite to a polarity of a channel of the first transistor.

7. The device as claimed in claim 6, wherein the fourth transistor separates the emission controller from the current supply circuit in the turn-on period of the scan signal.

8. The device as claimed in claim 5, wherein the switch includes:

a third transistor having a gate electrode that receives an emission signal, a first electrode connected to the current supply circuit, and a second electrode connected to the emission controller.

9. The device as claimed in claim 8, wherein the third transistor separates the emission controller from the current supply circuit in a turn-off period of the emission signal, the turn-off period of the emission signal corresponding to the turn-on period of the scan signal.

10. The device as claimed in claim 9, wherein the current supply circuit includes:

a storage capacitor having a first electrode connected to a power supply voltage;

a fifth transistor having a gate electrode connected to a second electrode of the storage capacitor, a first electrode connected to the power supply voltage, and a second electrode connected to the switch;

a sixth transistor having a gate electrode that receives the scan signal, a first electrode connected to the second electrode of the fifth transistor, and a second electrode connected to the gate electrode of the fifth transistor; and a seventh transistor having a gate electrode that receives the scan signal, a first electrode connected to the second electrode of the fifth transistor, and a second electrode connected to the external constant current source.

11. The device as claimed in claim 10, wherein a sinking current flowing through the external constant current source is determined to be the emission current.

12. The device as claimed in claim 11, wherein the seventh transistor connects the external constant current source with the second electrode of the fifth transistor in the turn-on period of the scan signal, to allow the sinking current to flow between the first electrode of the fifth transistor and the second electrode of the fifth transistor.

13. The device as claimed in claim 12, wherein the sixth transistor connects the second electrode of the fifth transistor with the second electrode of the storage capacitor in the turn-on period of the scan signal, to change an amount of charges of the storage capacitor.

14. The device as claimed in claim 13, wherein the storage capacitor stores a voltage difference between the first electrode of the fifth transistor and the gate electrode of the fifth transistor in the turn-on period of the scan signal, the voltage difference caused by the sinking current flowing between the first electrode of the fifth transistor and the second electrode of the fifth transistor.

15. The device as claimed in claim 14, wherein the fifth transistor generates the emission current based on the voltage difference stored in the storage capacitor in the turn-off period of the scan signal.

16. An organic light emitting display device, comprising:

a display panel having a plurality of pixel circuits to control emission of light based on an emission current;

a current driver having at least one constant current source to determine the emission current based on a sinking current operation for each of the plurality of pixel circuits;

a scan driver to provide a scan signal to the plurality of pixel circuits;

a data driver to provide data signals to the plurality of pixel circuits; and a timing controller to control the current driver, scan driver, and data driver, wherein each of the plurality of pixel circuits includes:

an emitter to emit light based on the emission current;

an emission controller to control an emission operation of the emitter based on the scan signal and data signal;

a current supply circuit to adjust the emission current based on the current sinking operation, the current supply circuit connected to the at least one constant current source; and a switch to control an electrical connection operation between the emission controller and current supply circuit.

17. The device as claimed in claim 16, wherein the emitter includes: an organic light emitting diode to emit the light based on the emission current.

18. The device as claimed in claim 17, wherein a sinking current flowing through the at least one constant current source in a turn-on period of the scan signal corresponds to the emission current supplied in a turn-off section of the scan signal to the organic light emitting diode.

19. A method of driving an organic light emitting display device, the method comprising:

determining an emission current for each of plurality of pixel circuits based on a current sinking operation performed by a constant current source in a turn-on period of a scan signal; and controlling an organic light emitting diode of each of the pixel circuits to emit light by supplying the emission current to the organic light emitting diode in a turn-off period of the scan signal, controlling the organic light emitting diode including:

controlling an emission operation of the organic light emitting diode based on a scan signal and a data signal;

adjusting the emission current based on the current sinking operation, and controlling an electrical connection operation between an emission controller and the constant current source based on an emission signal.

* * * * *